US005600420A

United States Patent [19]

Saito et al.

[11] Patent Number: 5,600,420

[45] Date of Patent: Feb. 4, 1997

[54] IMAGE TRANSFER ELEMENT IN A COLOR IMAGE FORMING APPARATUS

[75] Inventors: Masahiko Saito, Kitaibaraki; Masashi Yamamoto, Hitachi; Tetsuro Akasaki, Hitachinaka; Koichi Niwa, Hitachi; Jin Sawahata, Hitachioota; Masahiro Nakano, Hitachi; Motoyuki Suzuki, Kitaibaraki; Toshiya Sato, Hitachi, all of Japan

[73] Assignee: Hitachi, Ltd., Tokyo, Japan

[21] Appl. No.: 348,692

[22] Filed: Dec. 2, 1994

[30] Foreign Application Priority Data

Dec. 17, 1993 [JP] Japan ..... 5-317707
Feb. 22, 1994 [JP] Japan ..... 6-023975

[51] Int. Cl.[6] ..... G03G 15/14

[52] U.S. Cl. ..... 399/302

[58] Field of Search ..... 355/271, 281, 355/273–275, 212, 213; 430/69, 126

[56] References Cited

U.S. PATENT DOCUMENTS 4,040,732 8/1977 Hummel ..... 355/213
5,415,961 5/1995 Yu et al. ..... 430/69 X

FOREIGN PATENT DOCUMENTS 1-198773 8/1989 Japan .

*Primary Examiner*—William J. Royer
*Attorney, Agent, or Firm*—Kenyon & Kenyon

[57] ABSTRACT

An intermediate transfer unit is constructed by covering a conductive cylindrical base member of drum-shape with an elastic member of belt-shape, the elastic member of belt-shape being adhesively fixed to the base member with an adhesive agent, grooves or pits being provided on the surface of the cylindrical base member, the elastic member of belt-shape being adhesively fixed by the adhesive agent filled in the grooves or pits. The adhesive agent has a resistivity smaller than at least the resistivity of the elastic member of belt-shape. By doing so, it is possible to construct and keep the uniform distribution of resistivity without change by environment and deterioration with age, and to realize proper transferring. Furthermore, since the diametrical change of the drum due to uneven application of the adhesive agent can be minimized, the effect on misalignment in color can be minimized.

12 Claims, 4 Drawing Sheets

IMAGE TRANSFER ELEMENT IN A COLOR IMAGE FORMING APPARATUS

BACKGROUND OF THE INVENTION

1. Field of the Invention

The present invention relates to a color image forming apparatus such as a copying machine, laser beam printer or the like and, more particularly, to a color image forming apparatus which has intermediate transfer means.

2. Description of the Related Art

With regard to image forming methods to obtain color images, there is a method where a multi-colored toner image is formed by repeating to transfer toner images having different colors from a latent image holding means to an intermediate transfer means color by color, the multi-colored toner image being transferred onto a material to be transferred.

With regard to color image forming apparatus using such intermediate transfer means, an apparatus using a cylindrical drum as the intermediate transfer means is disclosed in Japanese Patent Application Laid-Open No.1-198773 (1989).

Generally, there are various kinds of image forming methods to form a multi-colored image using an intermediate transfer means as the reference described above. However, in the apparatus employing this method, a multi-colored toner image is formed on an intermediate transfer means by repeating to sequentially transfer each of toner images having different colors from a latent image holding means to the intermediate transfer means color by color, the multi-colored toner image being transferred onto a material to be transferred to form a multi-colored image. In performing plural times of transferring images as described above, if the condition of transferring image for the following color is not nearly the same as the condition of the transferring image for the first color, there appears differences in the transfers so that the gradations of color in the final image becomes different from its original.

Further, when an image is formed by superposing toner images, misalignment possibly occurs between each color of the toner images.

The problems in connection with transfer and misalignment are especially important for color image forming apparatus, and become a cause to affect the reproducibity of color and the gradation of color. Therefore, it comes that no desired image can be obtained. This is a significant technical challenge to be overcome.

In order to perform transfer preferably, the intermediate transfer body should be of a proper semi-conductive resistivity. And the distribution of resistivity should be uniform throughout the whole surface without unevenness. When the distribution of resistivity is non-uniform and uneven, a miss-transfer occurs. Therefore, the conductive cylindrical base member of drum-shape in the intermediate transfer body has to be coated with a semi-conductive resistive member. With regard to a coating method, the conductive cylindrical base member of drum-shape is covered with a semi-conductive elastic member of belt-shape. The elastic member has a diameter smaller than that of the cylinder of drum-shape, and is expanded and tightly held on the drum by elastic force. Therein, the belt may be simply adhered onto the drum to be fixed. When the whole surface of the belt is adhered, uniform distribution of resistance cannot be obtained due to bubble formation or unevenness in applying of adhesive agent, which leads to malfunction in transfer. Therefore, the belt is held by contracting force without any interposed material. In this construction, when the belt becomes loose due to environmental change or deterioration with age, a very small air layer existing between the belt and the cylinder of drum-shape becomes a large lump due to attraction of the belt by high voltage during transferring. The air lump makes a local and non-uniform resistivity and probably causes a local transfer fault. Further, there is also a possibility to cause misalignment in color by change in the size of the outer diameter of the drum due to the air layer. Further, it is necessary to decrease the adhesiveness of the surface layer in the intermediate transfer body to which toner adheres. In a case there the surface has adhesiveness, where is possibility to decrease the transfer efficiency and the cleaning efficiency for removing remaining toner after transfer, which causes problems of difference in gradations of color, occurrence of ghost or the like. In the reference described above, the change in environment and deterioration with age are not taken into consideration, and therefore, there is a possibility to cause a serious image fault by occurrence of the problem described above.

SUMMARY OF THE INVENTION

An object of the present invention is to solve the aforementioned problem and construct an intermediate transfer means capable of multi-colored and uniform transfer and to provide a color image forming apparatus using the intermediate transfer means.

In order to attain the above object, the intermediate transfer means is constructed by covering a conductive cylindrical base member of drum-shape with an elastic member of belt-shape (thickness of the belt is t(mm)) on the surface of the base member, and grooves or pits having depth and width of 10 μm to t/5 (mm) are provided on the surface of the base member. And the grooves are spiral grooves having a pitch in the lateral direction of 0.1 mm to 5 mm, or the pits are formed by sandblast working.

Further, the intermediate transfer means is also constructed by covering a conductive cylindrical base member of drum-shape with an elastic member of belt-shape (thickness of the belt is t(mm)), the elastic member of belt-shape being adhesively fixed to the base member with an adhesive agent, grooves or pits having depth and width of 10 μm to t/5 (mm) being provided on the surface of said base member, said elastic member of belt-shape being adhesively fixed by the adhesive agent filled in the grooves or pits. The adhesive agent used for adhesively fixing the conductive cylindrical base member of drum-shape and the elastic member of belt-shape has a resistivity smaller than at least the resistivity of the elastic member of belt-shape. And the adhesive agent is favorably a silicon adhesive agent of moist curing type.

Since the intermediate transfer means having the aforementioned construction is constructed by covering the conductive cylindrical base member of drum-shape with the elastic member of belt-shape (thickness of the belt is t(mm)), the semi-conductive resistivity required by the intermediate transfer body is composed of only the resistivity of the belt. Further, the small air layer existing between the cylinder of drum-shape and the elastic member of belt-shape is absorbed in the grooves provided on the surface of the cylindrical base member of drum-shape. Therefore, even if the tightening force of the belt becomes small due to change in environment or deterioration with age, the phenomenon to form a large lump of air due to high voltage during transferring does not occur, and it is possible to keep uniform distribution of resistance and to realize a preferable transfer. The grooves can be easily formed by turn machining since the grooves are formed in spiral in the rotation direction. And the pits can be also easily formed by sandblasting work.

In order to further improve reliability, the intermediate transfer means is constructed by covering the conductive cylindrical base member of drum-shape with an elastic member of belt-shape and the elastic member of belt-shape is adhesively fixed by an adhesive agent. Therein, since the cylindrical drum has the grooves or pits, the adhesive agent can be uniformly applied into the grooves or pits. The elastic member of belt-shape is adhesively fixed by the adhesive agent filled in the grooves or pits. Further, since the adhesive agent has a resistivity smaller than the resistivity of the belt, the uniform distribution of semi-conductive resistivity can be kept even when the adhesive agent exists between the belt and the cylinder of drum-shape. Furthermore, when an adhesive agent used is of a silicon conductive adhesive agent of moist curing type, malfunction caused by bubbles does not occur since the amount of volatile components during curing is very small. In a case where the amount of volatile components is large, the volatile components form distinct bubbles enclosed between the belt and drum to cause malfunction in transferring. Thereby, the uniform distribution of resistivity can be kept and preferable transfer can be realized regardless of change in environment and deterioration with age.

The outer diameter change due to unevenness in applying adhesive agent can be minimized and the misalignment in color is, therefore, little affected.

In order to decrease the adhesiveness on the surface layer of an intermediate transfer body, fine particles having a diameter smaller than one half of the diameter of toner particles are fixed to the surface. Further, a coating layer is formed on the elastic member and fine particles having a diameter smaller than one half of the diameter of the toner particles are fixed to the surface. By fixing the fine particles, the adhesiveness on the surface layer can be decreased, and consequently the transfer efficiency can be improved and the cleaning efficiency can be also improved.

With the construction described above, it is possible to obtain an intermediate transfer body for a color image forming apparatus being simple in construction, high in reliability and low in cost. And it is also possible to realize a construction without malfunction in transfer and with little misalignment in color.

DETAILED DESCRIPTION OF THE PREFERRED EMBODIMENTS

An embodiment of the present invention will be described below, referring to the accompanying drawings.

Figure 12:
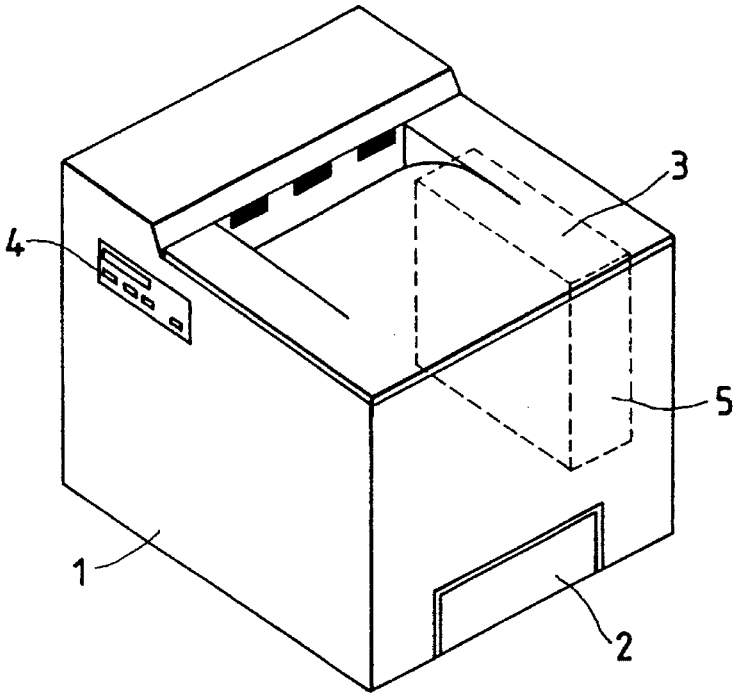
FIG. 12 is a perspective view showing the appearance of a color laser printer in accordance with the present invention.

FIG. 12 is a perspective view of a color laser printer which is an embodiment of a color image forming apparatus according to the present invention. A paper cassette 2 is provided in the right down side of a main body 1. Printed paper is stacked on a top cover 3 on the upper surface of the main body 1. A panel 4 for print control and displaying messages is provided in front of the main body 1. A controller 5 for controlling print processes and interfacing with a computer is arranged in the rear inside of the main body 1.

Figure 13:
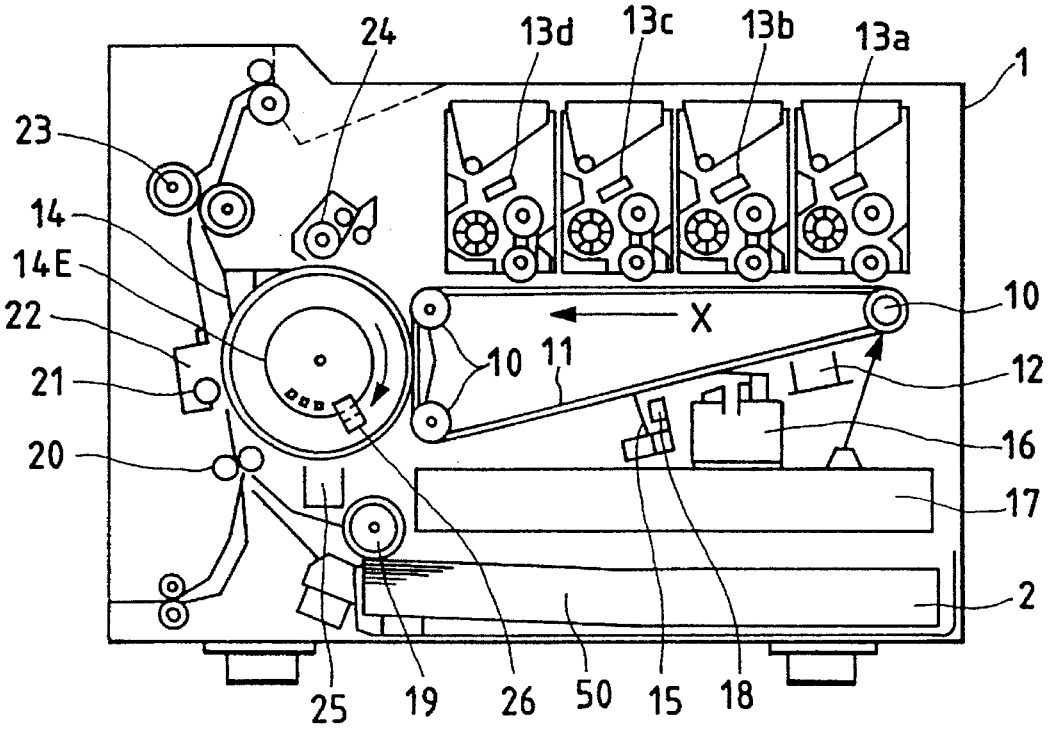
FIG. 13 is a vertical cross-sectional view of the color laser printer shown in FIG. 12.

FIG. 13 is a schematic view showing the internal construction of an embodiment of a color laser printer. Latent image forming means (photosensitive member) 11 of belt-shape stretched by three rotatable rollers 10 is provided in the right central portion of the main body 1. The photosensitive belt 11 is of a two-layer structure (not shown), a photosensitive layer (for example, OPC) on its surface and a conductive layer (for example, aluminum) beneath the photosensitive layer. Voltage to transfer toner to an intermediate transfer means is applied to the lower conductive layer. The length of the photosensitive belt 11 has to be longer than the length required for an image since the belt has a connected portion. In the embodiment, the length is composed of a length for two images and 8 cm as margin sufficiently longer than the change in the round length of the photosensitive belt 11 due to environmental change and deterioration with age. A belt mark is provided on the side end portion of the photosensitive belt 11 several millimeters apart from the connected portion of the belt. Further, the photosensitive belt 11 moves toward the X-direction in the figure. Near the photosensitive belt 11, there are provided in order along the X-direction a photosensitive member charger 12, exposing means 17, developing means 13*a*, 13*b*, 13*c*, 13*d*, an intermediate transfer body (drum) 14, an erasing lamp 15, belt mark detecting means 18, a cleaner 16. Around the intermediate transfer drum 14, there are provided an intermediate transfer cleaner 24, a pre-charger 25 and intermediate transfer body position detecting means 26.

The photosensitive charger 12 is a scrotron charger which charges the photosensitive belt 11 with discharge of a corotron and voltage control of a grid plate.

The exposing means 17 is so constructed that light of a semiconductor laser (not shown) is focused in a spot on the surface of the photosensitive belt 11 to form a latent image on the photosensitive belt 11 by scanning the spot to expose.

Figure 1:
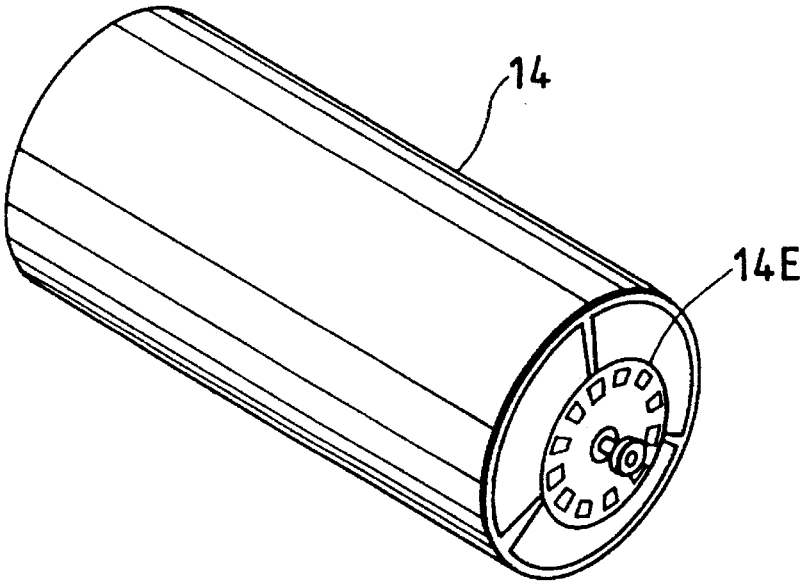
FIG. 1 is a perspective view showing the appearance of an intermediate transfer drum in accordance with the present invention.
Figure 2:
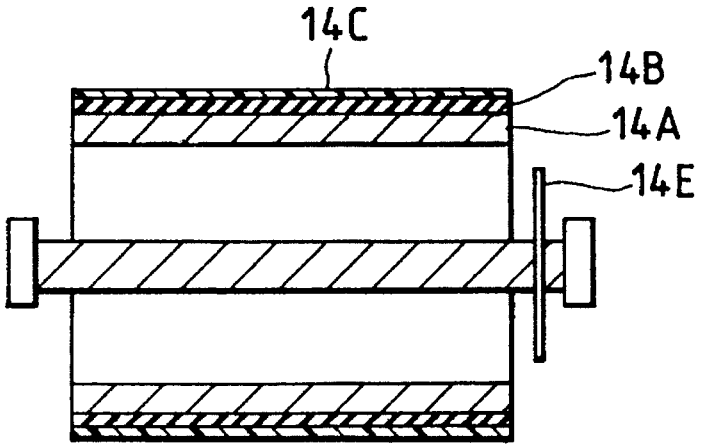
FIG. 2 is a vertical cross-sectional side view of the intermediate transfer drum shown in FIG. 1.
Figure 3:
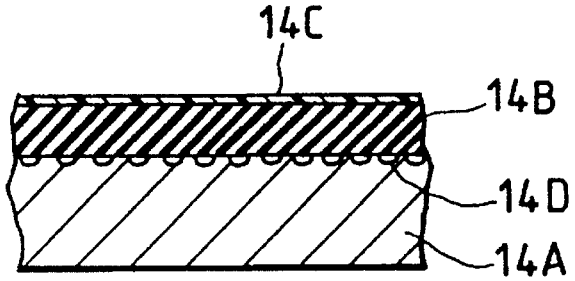
FIG. 3 is an enlarged view showing a part of the cross-sectional view of the intermediate transfer drum shown in FIG. 2.

The types of four developing units composing the developing means 13*a*, 13*b*, 13*c*, 13*d* are all the same but the toner colors are different from each other. For example, yellow toner, magenta toner, cyanic toner or black toner is contained in the each developing unit to develop an image in each color. And each of the developing units operates independently of each other. As shown in FIG. 1 to FIG. 3, the intermediate transfer drum 14 is formed by covering a conductive cylindrical base member of drum-shape 14A (for example, an aluminum drum having a diameter of 108 mm) with an elastic member of belt-shape 14B (thickness of t mm) (for example, thickness of 1 mm, made of a material such as polyurethane rubber, nitrile rubber, silicon rubber, chloroprene rubber, hydrine rubber, acrylic rubber, fluoro-rubber or the like properly conductive-treated to adjust the electric conductivity). A single layer coating layer 14C is applied on the surface of the belt. The coating material contains a material having a characteristic of easily flaking off of toner such as fluorocarbon resin, silicone or the like to improve the efficiency of transferring toner from the intermediate transfer drum 14 to paper 50. Since an image on the paper, therefore, can have a sufficient density with small amounts of the toner, it is possible to minimize the mal-effect caused by a diametric change due to increase in the thickness of toner layer on the intermediate transfer drum 14.

Grooves or pits 14D having depth and width of 10 μm to t/5 (mm) are provided on the surface of the conductive cylindrical base member of drum-shape 14A in the intermediate transfer drum 14. There, the magnitude of t/5 is to restrict the surface roughness for the base member such that the effect of the roughness does not appear to the surface of the belt. It has been confirmed that when the depth of the pits are deeper than the value, the effect appears on the surface of the transfer member to cause a problem to disturb a transferred image. The depth and the width are preferably 50 to 100 μm. Further, the grooves are formed in spiral-shape in the rotating direction having a pitch in the width direction of 0.1 mm to 5 mm, and the pits are formed by sandblast working.

Figure 4:
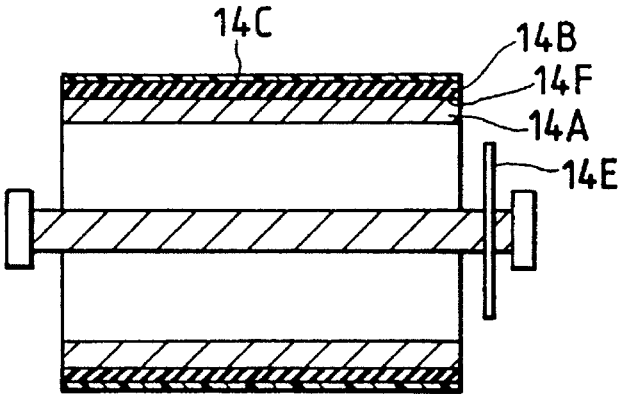
FIG. 4 is a vertical cross-sectional side view showing a modified example of the intermediate transfer drum shown in FIG. 1.
Figure 5:
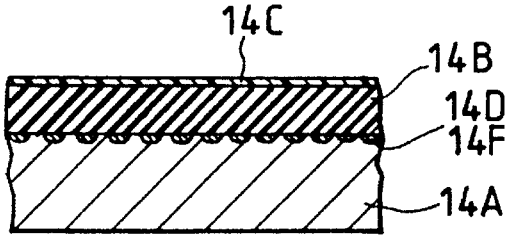
FIG. 5 is an enlarged view showing a part of the cross-sectional view of the intermediate transfer drum shown in FIG. 4.

The intermediate transfer drum 14 is, as shown in FIG. 4 and FIG. 5, constructed by covering a conductive cylindrical base member of drum-shape 14A with an elastic member of belt-shape 14B (thickness of the belt is t mm) on the surface of the base member and the elastic member of belt-shape 14B is adhesively fixed with an adhesive agent 14F, and grooves or pits 14D having depth and width of 10 μm to t/5 (mm) are provided on the surface of the cylindrical base member of drum-shape 14A. The adhesive agent 14F filled in the grooves 14D adhesively fix the elastic member of belt-shape 14B. The adhesive agent 14F used for adhesively fixing the conductive cylindrical base member of drum-shape 14A and the elastic member of belt-shape 14B has a resistivity smaller than at least the resistivity of the elastic member of belt-shape. And the adhesive agent is preferably a silicon adhesive agent of moist curing type. By doing so, it is possible to construct and keep the uniform distribution of resistivity without change by environment and deterioration with age, and to realize proper transferring.

Furthermore, since the diametrical change of the drum due to uneven application of the adhesive agent can be minimized, the effect on misalignment in color can be minimized.

Figure 6:
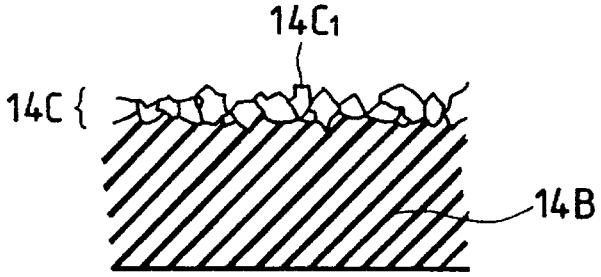
FIG. 6 to FIG. 11 are enlarged views showing the surface parts of the intermediate transfer drums illustrated in the above figures.
Figure 7:
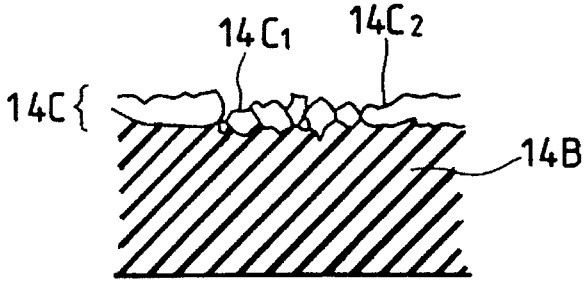

The surface layer of the intermediate transfer drum 14 according to the present invention will be described in detail below. FIG. 6 is a schematic view showing the surface of an intermediate transfer drum 14 used in this embodiment. The aforementioned coating layer 14C has fine particles $\mathbf{14C_1}$ fixed on the surface of the elastic member 14B. By covering the surface of the elastic layer with the fine particles, the adhesive capability of the elastic member is decreased. Suppressing adhering force of toner with the surface construction is similar to the phenomenon where the adhesive capability of an adhesive tape is eliminated by adhering sand on the surface of the adhesive tape. A structure having the same effect may be the surface structure shown in FIG. 7. The structure shown in FIG. 7 is that the aforementioned layer 14C is constructed by forming resin layers $\mathbf{14C_2}$ on the surface of an elastic member 14B and fixing fine particles $\mathbf{14C_1}$ on the surface of gap portions between the resin layers $\mathbf{14C_2}$. In this case, the resin layers $\mathbf{14C_2}$ are formed in being scattered as islands over the surface such the elasticity may be kept. The surface structure of the intermediate transfer drum 14 also preferably has both of elasticity and non-adhesive capability.

Therein, it is not necessary to form the elastic member 14B and the coating layer 14C in single layers. For example, urethane rubber has a characteristic to be deteriorated by the effect of ozone produced from the charger 12. Therefore, when urethane rubber is used as the material for the elastic member 14B, in order to protect the deterioration, it is preferable to cover the surface of the elastic member 14B with a layer made of some other material (for example, fluoro-rubber, fluorocarbon resin dispersed fluoro-rubber).

Figure 8:
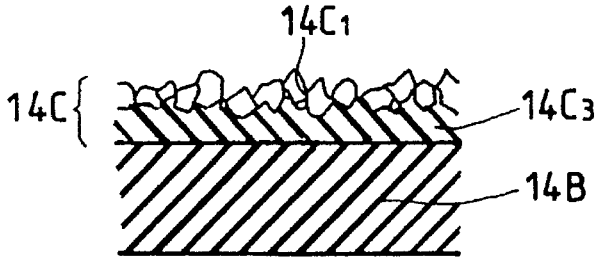
Figure 9:
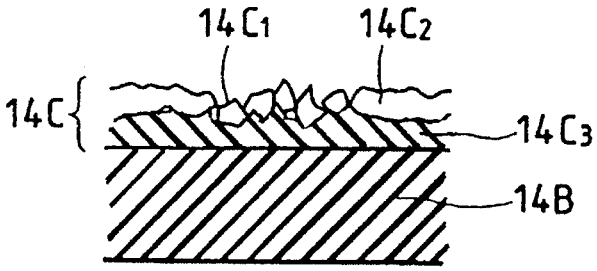

FIG. 8 and FIG. 9 show embodiments having two-layer structure of the aforementioned coating layer 14C to protect the deterioration of the elastic member 14B and have non-adhesive capability. In the embodiment shown in FIG. 8, an intermediate layer $\mathbf{14C_3}$ made of fluoro-rubber is applied to the surface of an elastic member 14B made of urethane rubber and fine particles $\mathbf{14C_1}$ are fixed on the surface.

In the embodiment shown in FIG. 9, fluorocarbon resin layers $\mathbf{14C_2}$ and fine particles made $\mathbf{14C_1}$ of fluorocarbon resin are fixed in the surface of an intermediate layer $\mathbf{14C_3}$ made of fluoro-rubber.

Figure 10:
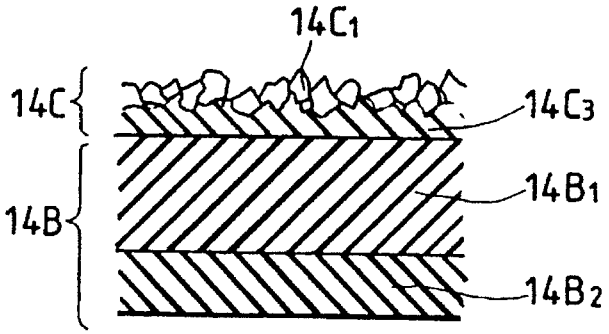
Figure 11:
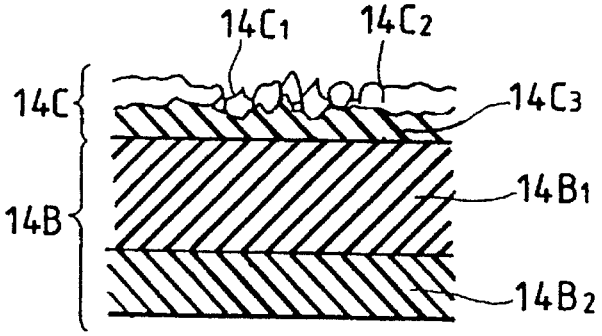

In order to control the resistivity of the intermediate transfer drum 14, there may be provided a layer to adjust resistivity inside the elastic member 14B (materials are selected corresponding to the resistivity of not only the elastic member 14B but each of the layers, for example, for high resistivity, blocking layer used for a base of photosensitive member; for middle resistivity such as PET, rubber material such as fluoro-rubber and semi-conductive plastic). FIG. 10 and FIG. 11 are cross-sectional views showing the surfaces of the intermediate transfer drum 14 having an insulating layer $\mathbf{14B_2}$ in the lower layer of an elastic member $\mathbf{14B_1}$. In a case where the resistive layer is formed in the lowermost layer of the elastic member $\mathbf{14B_1}$, the resistive layer is not always required to have elasticity. However, in a case where the resistive layer is formed in the middle or the uppermost layer of the elastic member $\mathbf{14B_1}$, the resistive layer is required to have elasticity.

As the fine particles $\mathbf{14C_1}$, particles having an average diameter smaller than one-half of the average diameter of the toner are used. Material of the fine particles consists of base material not adhering the toner such as silica ($SiO_2$), polyester resin, acrylic resin, fluorocarbon resin or the like. By fixing at least one kind of the particles formed of these materials to the surface of the intermediate transfer drum 14, the adhesive force between the surface and the toner can be decreased. Although there can be used various kinds of the particles, it is preferable with considering peeling-off of the particles to use particles made of the material containing the same component as the component composing the members contacting to the intermediate transfer drum such as the toner and the photosensitive member not so as to give mal-effects to other processes such as fixing process.

Method of fixing the fine particles $\mathbf{14C_1}$ to the surface of the intermediate transfer drum 14 will be described below.

A frictionizing member is contacted to the surface of the intermediate transfer drum 14, then fine particles $14C_1$ being entered into the contact portion, the fine particles $14C_1$ are fixed to the surface of the intermediate transfer drum 14 with frictional contact by giving speed difference to cause friction. On this time, fixing can be performed in a comparatively short time if particles having a diameter larger than that of the fine particles $14C_1$ are mixed and frictionized. The surface is wiped with a dry cloth last to remove foreign substances on the surface. Since the fine particles $14C_1$ fixed in such a way are fixed to the intermediate transfer drum 14 comparatively strongly, the fine particles are hardly removed even if the surface is wiped with cloth using a solvent such as alcohol, and it is, therefore, possible to clean and use the intermediate transfer drum 14.

The resin layer $14C_2$ is formed of a resin having a high flaking capability of toner such as fluorocarbon resin or the like. The layer may be formed to have a thickness smaller than 50 μm and using a material having a high hardness. However, it is necessary to form the resin layer in spatted island-like (size smaller than 20 μm by 20 μm is preferable) not so as to decrease the elasticity of the elastic member $14B_1$. The layer is formed through spray coating of fluorocarbon.

Although the intermediate transfer means is of a dram-shape, when the intermediate transfer mean is of a belt-shape, it is also possible to obtain a proper characteristic by fixing fine particles on the surface in the same way as described above.

Fixing fine particles onto a surface as described above can be effectively applied to a member contacting with toner and requiring elasticity other as well as the intermediate transfer drum 14. The surface treatment similar to that in the embodiment has been applied to, for example, the surface of a transfer roller or a transfer belt. The results are that soil on the roller or the belt with toner is decreased, and in addition to this cleaning of the members can be easily performed. Further, since the thermally stable fine particles are fixed to the surface of a fixing roller, it can be attained to decrease an offset. The application described above is applicable to an apparatus for forming images of other types as well as to the apparatus for forming images of intermediate transfer type as in the embodiment.

The conductive cylindrical base member of drum-shape 14A is electrically grounded. An encoder 14E is provided on the left-hand side of the intermediate transfer drum 14 and has 32 perforations in spaced relation of equal pitches. The photosensitive belt 11 is pressed to the intermediate transfer drum 14 with a proper pressure in contacting with a nip width of 5 to 20 mm. The nip width can be formed widely since the photosensitive member is belt-shaped, and, therefore, transfer can be performed properly. Further, since the nip width is wide, the photosensitive belt 11 may be driven by driving the intermediate transfer drum 14.

The erasing lamp 15 irradiates light on the photosensitive belt 11 after transferring to remove remaining electric potential.

The belt position detector 18 detects a mark on the photosensitive belt using a photosensor.

The cleaner 16 removes the remaining toner remaining on the photosensitive belt after transferring.

The intermediate transfer cleaner 24 removes the toner remaining on the intermediate transfer drum 14 after transferring. The intermediate transfer cleaner 24 is constructed such as to be held back when a toner image is formed on the intermediate transfer drum 14.

The pre-charger 25 is operated just before transferring the image to paper in order to align the electric potential of a toner on the intermediate transfer drum. The drum position detecting means 26 detects the position of the perforations on the encoder 14E placed on the left side end of the intermediate transfer drum 14.

A paper cassette 2 is placed under the photosensitive belt in the lower portion of the main body 1. A transporting roller 19 is provided above the paper cassette 2 inside the main body 1 to extract a sheet of paper 50 from the paper cassette 2, and the paper is discharged onto the upper top cover 3 through the register roller 20, the transfer roller 21, the discharger 22, and the fixing unit 23.

The register roller 20 is to align the top front of the paper 50. The transfer roller 21 is to transfer a toner image formed on the intermediate transfer drum 14 to the paper 50, and is composed of a metallic core and an elastic layer having a proper resistivity ($10^4$ to $10^{10}$ Ω) (not shown). A proper voltage is applied to the metallic core to optimize transferring of the toner from the intermediate transfer drum 14 to the paper 50. The transfer roller 21 is so constructed as to be held back and not to contact the intermediate transfer drum 14 while a toner image is formed on the intermediate transfer drum 14. An AC corona charger is employed as the discharger 22 to discharge the paper 50 by irradiating AC corona. The fixing unit 23 fixes the toner on the paper 50.

The operation of an embodiment according to the present invention constructed as above will be described below. When a print command is input from a computer to the controller 5, the photosensitive belt 11 starts to move, the belt position detector 18 detecting a mark indicating the connecting portion of the photosensitive belt 11, the perforations of the encoder 14E coming just after the signal are detected by the drum position detecting means 26. With the signal, the exposing means 17 is started to expose on the photosensitive belt 11 charged by the photosensitive member charger 12 to form a latent image. The latent image is developed with any one of the developing units **13*a*, 13*b*, 13*c*, 13*d*. The developed image is transferred onto the intermediate transfer drum 14. The above process is repeated to form a multi-colored toner image on the intermediate transfer drum 14. The exposure to form images for after the second color is started by the same position detecting signal detected one round after by the encoder 14E** which is detected when the image for the first color start to expose.

As described above, since the timing for starting exposure is set the same for each color by taking a single position on the intermediate transfer drum 14 as a standard, plural toner images can be accurately superposed. In addition to this, a fault in image can be eliminated since the connecting portion of the photosensitive belt 11 is prevented from coming into the image region at least during superposing the four colored images by detecting the connecting portion of the photosensitive belt 11 by the belt position detecting means 18 in the exposure for the first color.

Since the intermediate transfer drum 14 having the construction described above can form a distribution of proper semi-conductive resistivity over the whole surface with uniformity and without unevenness, an optimized transfer can be performed nearly under the same condition even when transfer is repeated. In transferring, various kinds of high voltage are applied. Therein, in a conventional construction, there occurs the phenomenon where very small air layers existing in the reverse side surface of the belt are gathered to form a large lump due to the high voltage and causes a transfer fault. However, by providing the grooves or the pits on the surface of the cylindrical base member of drum-shape in the embodiment, it is possible to prevent transfer fault from occurring since the air is gathered to the groove placed near. In the intermediate transfer drum having a belt adhered to its reverse surface, the probability of forming a large air lump is decreased further.

In addition to this, since fine particles are fixed on the surface layer, the adhesiveness is decreased, and therefore the transfer efficiency and the cleaning performance can be improved.

Next, the multi-colored toner image formed on the intermediate transfer drum 14 is pre-charged by the pre-charger 25 to transfer by the transfer roller 21 to the paper 50 extracted from the paper cassette 2 by the transporting roller 19. Then the paper 50 is discharged and peeled off from the intermediate transfer drum 14 by the discharger 22, being transported to the fixing unit 23 to be fixed, then being discharged onto the upper top cover 3 of the main body 1.

With the construction described above, according to the present invention, even when the stretching force of the elastic member of belt-shape 14B loosens due to environmental change or deterioration with age, the intermediate transfer drum 14 is not affected, and transfer fault and misalignment in color do not occur. In a case where the elastic member of belt-shape 14B is wholly adhered and the adhesive agent exists between the cylinder of drum-shape 14A and the elastic member of belt-shape 14B, the uniform distribution of semi-conductive resistivity can be produced and maintained, and therefore preferable transfer can be realized. Further, since the diametrical change in the drum due to uneven application of the adhesive agent can be minimized, the construction which less affects to misalignment in color can be obtained. Furthermore, it becomes easy to clean the surface of the intermediate transfer drum 14.

With the construction described above, according to the present invention, it is possible to obtain an intermediate transfer body 14 being capable of properly transferring images without misalignment in color and being capable of coping with environmental change and deterioration with age. And it is also possible to provide a color image forming apparatus being simple and compact in construction and low in cost.

What is claimed is:

1. A color image forming apparatus for forming a color image having a belt-shaped latent image holder an exposure element forming a latent image by exposing said latent image holder to light, a plurality of developers having different toners and developing said latent image, an intermediate transfer element forming a color image by receiving and superposing plural toner images, a print transferer by which the color image formed on said intermediate transfer element is transferred onto a printed member, an image fixer fixing the color image transferred to said printed member, wherein:

said intermediate transfer element comprises a conductive cylindrical base member of drum-shape and an elastic member of belt-shape having a thickness of t (mm) coating the surface of said base member, wherein grooves or pits having a depth and width of 10 μm to t/5 (mm) are provided on the surface of said base member.

2. A color image forming apparatus according to claim 1, wherein:

said grooves formed on the surface of the cylindrical base member of drum-shape are spiral grooves having pitch in the lateral direction of 0.1 mm to 5 mm.

3. A color image forming apparatus according to claim 1, wherein:

said pits formed on the surface of the cylindrical base member of drum-shape are formed by sandblast working.

4. A color image forming apparatus according to claim 1, wherein:

fine particles having a diameter smaller than one-half of a diameter of toner particles from said developers are fixed on the surface of said elastic member of belt-shape.

5. A color image forming apparatus according to claim 1, wherein:

a coating layer is formed on a surface of said elastic member of belt-shape, and fine particles having a diameter smaller than a diameter of toner particles from said developers are fixed on the surface of said coating layer.

6. A color image forming apparatus according to claim 5, wherein:

said elastic member of belt-shape is formed of a material selected from the group consisting of urethane rubber, nitrile rubber, silicon rubber, chloroprene rubber, fluor rubber, hydrin rubber, acrylic rubber;

said coating layer is formed of a material selected from the group consisting of fluorocarbon resin, silicon resin;

said fine particles are formed of a material selected from the group consisting of silica, polyester resin, acrylic resin, fluorocarbon resin.

7. A color image forming apparatus for forming a color image having a belt-shaped latent image holder, an exposure element forming a latent image by exposing said latent image holder to light, a plurality of developers having different toners and developing said latent image, an intermediate transfer element forming a color image by receiving superposing plural toner images, a print transferer by which the color image formed on said intermediate transfer element is transferred onto a printed member, a fixing means for fixing the color image transferred to said printed member, wherein:

said intermediate transfer element comprises a conductive cylindrical base member of drum-shape covered with an elastic member of belt-shape having a thickness of t (mm), the elastic member of belt-shape being adhesively fixed to said base member with an adhesive agent, grooves or pits having a depth and width of 10 μm to t/5 (mm) being provided on the surface of said base member, said elastic member of belt-shape being adhesively fixed by the adhesive agent filled in the grooves or pits.

8. A color image forming apparatus according to claim 7, wherein:

said adhesive agent used for adhesively fixing the conductive cylindrical base member of drum-shape and the elastic member of belt-shape has a resistivity smaller than at least the resistivity of the elastic member of belt-shape.

9. A color image forming apparatus according to claim 7, wherein:

said adhesive agent used for adhesively fixing the conductive cylindrical base member of drum-shape and the elastic member of belt-shape has a resistivity smaller than at least the resistivity of the elastic member of belt-shape and is a silicon adhesive agent of moist curing type.

10. A color image forming apparatus according to claim 7, wherein:

fine particles having a diameter smaller than one-half of a diameter of toner particles from said developers are fixed on the surface of said elastic member of belt-shape.

11. A color image forming apparatus according to claim 7, wherein:

a coating layer is formed on the surface of said elastic member of belt-shape, and fine particles having a diameter smaller than a diameter of toner particles from said developers are fixed on the surface of said coating layer.

12. A color image forming apparatus according to claim 11, wherein:

said elastic member of belt-shape is formed of a material selected from the group consisting of urethane rubber, nitrile rubber, silicon rubber, chloroprene rubber, fluor rubber, hydrin rubber, acrylic rubber;

said coating layer is formed of a material selected from the group consisting of fluorocarbon resin, silicon resin; said fine particles are formed of a material selected from the group consisting of silica, polyester resin, acrylic resin, fluorocarbon resin.

* * * * *